US006056508A

United States Patent [19]

Johnson et al.

[11] Patent Number: 6,056,508

[45] Date of Patent: May 2, 2000

[54] COOLING SYSTEM FOR THE TRAILING EDGE REGION OF A HOLLOW GAS TURBINE BLADE

[75] Inventors: Bruce Johnson, Manchester, Conn.; Pey-Shey Wu, Chiayi, Taiwan; Bernhard Weigand, Waldshut-Tiengen, Germany; Prith Harasgama, Rekingen, Switzerland

[73] Assignee: ABB Alstom Power (Switzerland) Ltd, Baden, Switzerland

[21] Appl. No.: 09/111,778

[22] Filed: Jul. 8, 1998

[30] Foreign Application Priority Data

Jul. 14, 1997 [EP] European Pat. Off. ..... 97810475

[51] Int. Cl.[7] ..... F01D 5/18

[52] U.S. Cl. ..... 416/96 R

[58] Field of Search ..... 415/115; 416/96 R, 416/96 A, 97 R

[56] References Cited

U.S. PATENT DOCUMENTS

| | | | |
|---|---|---|---|
| 3,806,274 | 4/1974 | Moore | 416/97 R |
| 4,474,532 | 10/1984 | Pazder | 416/97 R |
| 5,002,460 | 3/1991 | Lee et al. | 416/96 A |
| 5,232,343 | 8/1993 | Butts | 416/97 R |
| 5,488,825 | 2/1996 | Davis et al. | 416/97 R |
| 5,536,143 | 7/1996 | Jacala et al. | 416/96 R |
| 5,634,766 | 6/1997 | Cunha et al. . | |
| 5,695,322 | 12/1997 | Jacobson et al. | 416/97 R |

FOREIGN PATENT DOCUMENTS

| | | | |
|---|---|---|---|
| 0130038 | 1/1985 | European Pat. Off. . | |
| 3248162 | 7/1983 | Germany . | |
| 1410014 | 10/1975 | United Kingdom | 416/96 R |
| 2112467 | 7/1983 | United Kingdom | 416/97 R |

OTHER PUBLICATIONS

"Augmented Heat Transfer in Triangular Ducts with Full and Partial Ribbed Walls", Zhang, et al., Journal of Thermophysics and Heat Transfer, vol. 8, No. 3, Jul.–Sep. 1994, pp. 574–579.

"Experimental Study of the Effects of Bleed Holes on Heat Transfer and Pressure Drop in Trapezoidal Passages with Tapered Turbulators", et al., May 24–27, 1993 Presentation at Gas Turbine and Aeroengine Congress and Exposition.

*Primary Examiner*—Christopher Verdier
*Attorney, Agent, or Firm*—Burns, Doane, Swecker & Mathis, L.L.P.

[57] ABSTRACT

In a cooling system for the trailing edge region of a hollow gas turbine blade, there extends from the blade root (1) to the blade tip (2) a duct (3) through which the flow passes longitudinally and which, in the region of the blade body (4), is delimited by the inner walls of the trailing edge (5), the suction side (6) and the pressure side (7) and by a web (9), the inner walls of the suction side and of the pressure side being provided with a plurality of ribs (8) running at least approximately parallel. The ribs (8) run obliquely from the web (9) in the direction of the trailing edge (5) and are directed radially outward on at least one of the two inner walls. The suction-side ribs and the pressure-side ribs are offset relative to one another over the blade height. The ratio of the height (h) of the ribs (8) to the local height (H) of the duct (4) is constant over the longitudinal extent of the ribs.

4 Claims, 2 Drawing Sheets

FIG.1
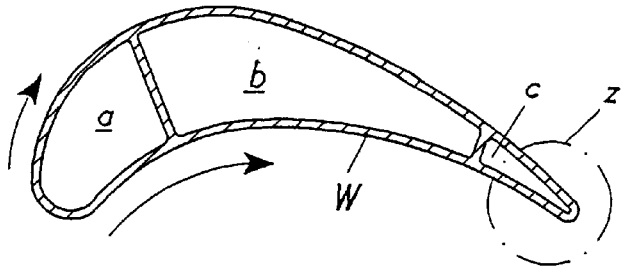
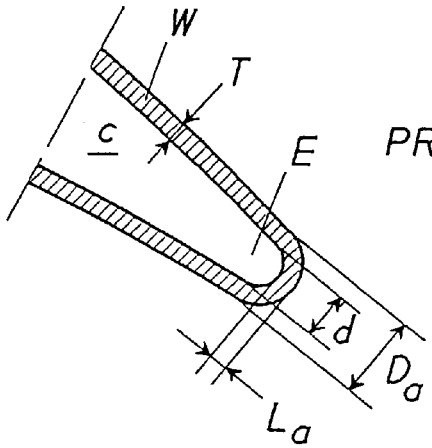
FIG.5
PRIOR ART
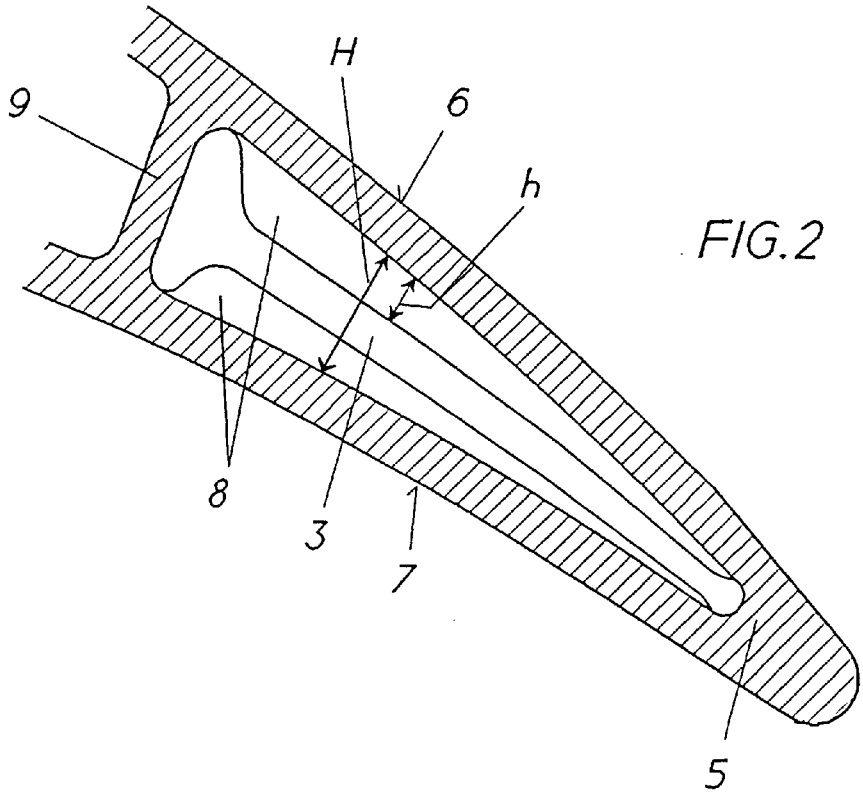
FIG.2

COOLING SYSTEM FOR THE TRAILING EDGE REGION OF A HOLLOW GAS TURBINE BLADE

FIELD OF THE INVENTION

The invention relates to a cooling system for the trailing edge region of a hollow gas turbine blade, and generally to a system for cooling a curved wall, round which the hot medium flows on one side and a coolant flows on its other side.

BACKGROUND OF THE INVENTION

Hollow internally cooled turbine blades with liquid, vapor or air as a coolant are sufficiently known. A problem is presented, in particular, by the cooling of the trailing edge region of such blades, through which the coolant flows in closed circuit. The walls forming the trailing edge surround a narrow gap, out of which the heat is to be discharged. For this purpose, for production reasons, the width of the narrow gap should not fall below a minimum value. In order to avoid overheating of the trailing edge, there also should not be any large accumulations of material. Furthermore, for reasons of strength, the wall thickness should not fall short of a specific value. These prerequisites mean that internally cooled blades are provided with large rounding radii at the trailing edge, and this has an adverse effect on the blade efficiency.

A cooling system of the initially mentioned type is known from German Patent No. 32 48 162. The region under consideration is equipped, on its inner walls, with ribs which run parallel to the machine axis from the trailing edge to the web. These ribs are provided for triggering and promoting turbulence. In this case, the ribs are at an appropriate distance from the actual trailing edge which is thus designed to be free of ribs. These ribs have a uniform height along their axial extent. The effective cooling of the actual trailing edge region is effected by blowing out the coolant via appropriately shaped elements.

Further considerations as to how heat transmission in so-called triangular ducts, such as the trailing edge region of a gas turbine blade represents, can be improved by means of ribs are set out in the periodical "Journal of Thermophysics and Heat Transfer", volume 8, No. 3, July–September 1994, on pages 574–579 in an article by Zhang et al.

The problem as regards the triangular ducts equipped with ribs of the same height is, however, that, due to the large cross section at the base of the triangle, too large a quantity of coolant flows through there on account of the low resistance, whereas only a small quantity of fluid, mostly in laminar form, flows in the other vertex of the triangle. This may lead to the inadequacies explained later.

SUMMARY OF THE INVENTION

Accordingly, one object of the invention is to provide a novel cooling system of the initially mentioned type, in which, by increasing the turbulence in the trailing edge region and by further measures, a considerable increase in the heat transmission coefficient can be achieved and the discharge of heat, particularly out of the existing narrow gap, is improved.

The cooling system of this invention makes it possible, inter alia, to design a blade trailing edge without blowout and thus allows the use of steam or other media for cooling the blade.

It is particularly expedient if the ratio of the height of the ribs to the local height of the duct increases from the trailing edge in the direction of the web or is constant over the longitudinal extent of the ribs. This measure makes it possible to achieve in each radial plane, from the trailing edge to the web, a cross section with at least approximately identical blocking and therefore uniform flow distribution. The advantage of this is that, as compared with the prior art initially mentioned, a trailing edge is acted upon to a greater extent and, at the same time, the web is relieved. The latter is important in order to avoid excessive stresses at the points where the cool web is connected on both sides to the hot blade walls. Furthermore, the rib configuration with a constant local duct height ensures that fluid passes into the corner regions of the duct and a turbulent flow prevails there. Moreover, the ribs having a constant local duct height ensure that a very strong secondary flow is initiated, which is controlled by the large rib height in the free duct cross section. This secondary flow extracts hot fluid from the corner regions and assists turbulent intermixing in these regions.

A further relief of the web region is achieved when the height of the ribs is prematurely reduced in the region of the web, in such a way that the rib does not reach as far as the web or else adjoins the web at only a low height. The fact that there is then a lack of turbulence in this region results in advantageous reduced cooling of the web in the connection region.

BRIEF DESCRIPTION OF THE DRAWINGS

A more complete appreciation of the invention and many of the attendant advantages thereof will be readily obtained as the same becomes better understood by reference to the following detailed description, when considered in connection with the accompanying drawings, wherein:

FIG. 1 shows a blade in cross section;

FIG. 2 shows the trailing edge region of the blade according to FIG. 1;

FIG. 5 shows a detail z from FIG. 1 with the trailing edge belonging to the prior art.

Figure 3:
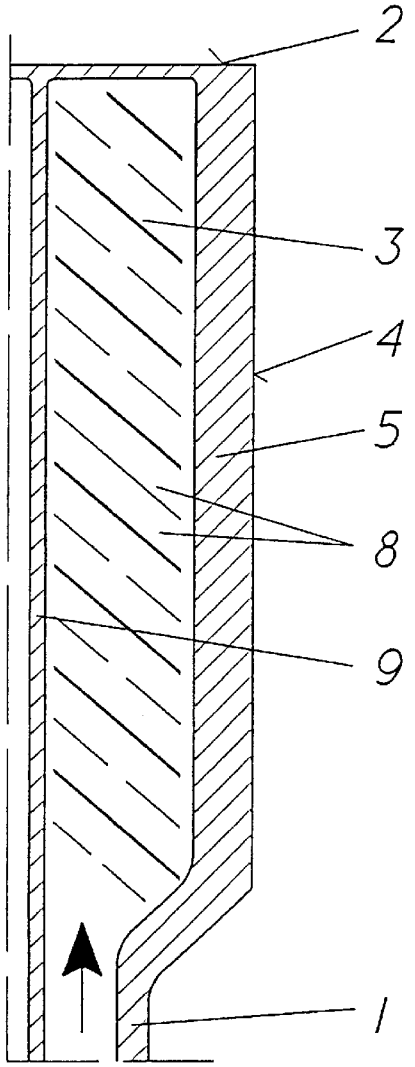
FIG. 3 shows a longitudinal section through the trailing edge region.

Only the elements essential for understanding the invention are shown. In particular, it is not illustrated how the cooling medium passes into the flow duct in the region of the trailing edge and is drawn off from the blade at the blade tip. The direction of flow of the media involved is designated by arrows.

DESCRIPTION OF THE PREFERRED EMBODIMENTS

Referring now to the drawings, wherein like reference numerals designate identical or corresponding parts throughout the several views, the cast blade illustrated in FIG. 1 has three inner chambers a, b and c, through which coolant, for example steam, flows perpendicularly to the drawing plane. In this case, the insides of the wall W, which forms the blade contour and round which hot gases flow externally on both sides, have the coolant flowing round them and discharge their heat to the coolant. As a rule, numerous aids, not shown here, such as guide ribs, flow ducts, inserts for impact cooling and the like, are provided, at least in the two front chambers a, b, for the purpose of improving the wall cooling. In the example, the coolant circulates in closed circuit, which means that coolant is not blown out into the flow duct either at the leading edge, the suction side, the pressure side or in the region of the trailing edge.

There are two problem regions in the rear chamber c. On the one hand, the actual thinwalled trailing edge, round which the hot gases flow and which requires particularly careful cooling, since there is no film cooling there by blowout, and, on the other hand, the connection points of the web 9 to the inner walls of the suction side 6 and pressure side 7, which connection points are under no circumstances to be cooled excessively.

The problem with the actual trailing edge geometry is explained with reference to FIG. 5. The narrow gap E formed by the walls has to have a minimum size so as to be capable of receiving sufficient coolant for discharging the heat which occurs. The inner edge rounding must therefore be designed with the diameter d. This minimum diameter is determined, as a rule, by the production method, for example casting. For reasons of strength, it is likewise not possible to fall short of a minimum wall thickness T. In order to avoid overheating of the trailing edge, there should not be any large accumulation of material there. As a rule, therefore, the dimension La corresponds to the wall thickness T. The result of all this is that the outer edge rounding must be designed with a relatively large diameter $D_a$. Cooled trailing edges are thus far known.

With the aid of the ribs known per se, which are cast together with the blade, but which have a new arrangement and geometry, the invention solves the prevailing problems in both regions by means of one and the same measure.

FIGS. 2 and 3 show the cooling system for the trailing edge region of a hollow gas turbine blade. There extends from the blade root 1 to the blade tip 2 a duct 3 through which the flow passes longitudinally and which corresponds to the chamber c in FIG. 1. In the region of the blade body 4, this duct is delimited by the inner walls of the trailing edge 5, the suction side 6 and the pressure side 7 and by a web 9 connecting the pressure side to the suction side. The inner walls of the suction side and of the pressure side are provided with a plurality of ribs 8 running obliquely and at least approximately parallel and which are arranged so as to be staggered over the blade height. The suction-side ribs and the pressure-side ribs are offset by half the pitch relative to one another over the blade height.

The ribs run radially outward from the web 9 in the direction of the trailing edge at an angle of 45°. It is to be expected that setting angles of between 15° and 75° are suitable. The effect of these obliquely set ribs, in addition to the inherent function, known per se, as a vortex generator, is the following:

The rib structure induces a secondary flow in the duct, said secondary flow conveying hot air out of the immediate region of the trailing edge into the middle of the duct. This hot air is replaced by colder air from the middle of the duct.

The offset arrangement of the ribs on the suction side 6 and the pressure side 7 causes the following:

As compared with a nonoffset arrangement very good fanning of heat transmission is thereby achieved due to intensification of turbulence along with a low pressure loss. The flow is constantly forced to avoid the obstacles, which the ribs constitute, on the pressure and suction sides, thus resulting in intensive heat transfer.

The ratio of the height h of the ribs to the local height H of the duct 3 increases from the trailing edge 5 in the direction of the web 9. This height increase is selected, in the example, in such a way that a duct of approximately equal width, through which the flow passes freely, is obtained between the trailing edge and web in each axial plane. This measure achieves uniform coolant distribution over the entire cross section through which the flow passes. Only by introducing a location-dependent rib height do the two abovementioned mechanisms for increasing heat transmission become particularly effective. The location-dependent rib height produces, in the duct, a flow which also flows into the narrow trailing edge region, since the flow resistances are now approximately the same here as in the remaining duct. Furthermore, the design of the new ribs in the cooling passage has a highly positive effect and acts to assist the abovementioned secondary flow in the duct, said secondary flow guiding the air out of the trailing edge into the front region of the duct. At the same time, the high ribs in the front region of the duct induce a very strong secondary flow.

Under specific conditions, it is advantageous, as has been demonstrated experimentally, if the ratio of the height h of the ribs to the local height H of the duct is constant over the longitudinal extent of the ribs.

As is evident from FIG. 2, the height h of the ribs decreases continuously toward zero in the region of the web 9. It goes without saying that, as a consequence of production, sharp-edged connections are hardly possible. As already mentioned, the advantage of this configuration is that, at the connection point of the web to the inner walls, the coolant flows, virtually undisturbed, along the walls and consequently generates a lower cooling effect. The intermediate web 8 should, of course, never become too hot. Should this be possible due to the selected configuration, there is always the possibility of leading the ribs further as far as the web at an adapted height, that is to say at the same or a reduced height.

The height h of the individual ribs staggered over the blade height may, of course, be adapted to the locally prevailing heat load. Enlarging the ribs toward the blade tip is appropriate particularly when the coolant has already become highly heated on its way through the duct, so that, if the rib height is low, the necessary temperature difference between the wall to be cooled and the coolant for the sought after heat exchange no longer becomes smaller.

A similar effect may be achieved by making the spacing of the ribs variable over the blade height. Of course, both measures may also be combined.

Figure 4:
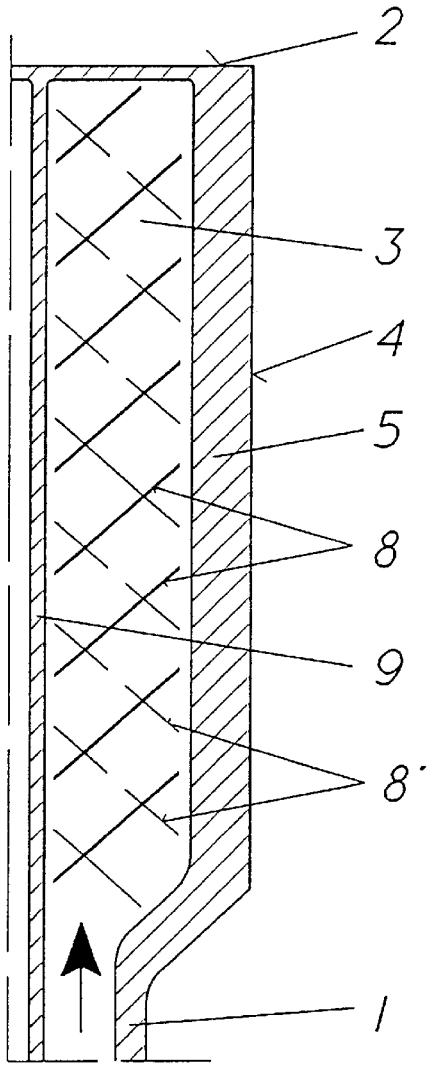
FIG. 4 shows a variant of the rib arrangement.

FIG. 4 illustrates a variant, in which the ribs 8 on the pressure side 7, said ribs likewise being widened in the direction of the web, are directed radially outward from the web 9 in the direction of the trailing edge 5 and the ribs 8' on the suction side 6 are directed radially inward from the web in the direction of the trailing edge. This variant is based on the consideration that more heat has to be discharged on the blade side subjected to a higher heat load, if the aim is to achieve uniform metal temperatures over the profile circumference in the trailing edge region.

Under given conditions, that is to say the geometry and wall thickness of the trailing edge and of the lateral walls; the geometry of the chamber c through which the coolant is to flow; the heat load on the blade trailing edge; the type, temperature and flow velocity of the coolant, therefore, the selection of the rib setting angle, the local height of the ribs projecting into the channel through which the flow passes, and the number and pitch of the ribs staggered over the blade height in the radial plane are critical for constant metal temperatures over the body height.

Measurements have shown that the heat transition coefficient is higher by a multiple with the new obliquely set ribs having a locally variable height than with the known ribs running in the axial direction.

Obviously, numerous modifications and variations of the present invention are possible in light of the above teachings. It is therefore to be understood that, within the scope of the appended claims, the invention may be practised otherwise than as specifically described herein.

What is claimed is:

1. In a cooling system for a hollow gas turbine blade of the type having a blade root and a blade tip, the blade having a suction side wall and a pressure side wall joined together to form a trailing edge, the blade also having a web extending between the suction side wall and the pressure side wall, the side walls and the web forming a duct through which fluid may be conducted to cool the blade, the improvement comprising a plurality of ribs projecting into the duct from the pressure side wall and a plurality of ribs projecting into the duct from the suction side wall, the ribs extending obliquely to the web, the suction side wall ribs being offset relative to the pressure side wall ribs, the height of the projection of the ribs from the side walls increases from the trailing edge toward the web and the height of the ribs decreases adjacent the web, whereby when a cooling fluid is conducted through the duct, the cooling fluid flows substantially undisturbed along the web and the ribs cause the fluid to flow effectively toward the trailing edge.

2. The cooling system as claimed in claim 1, wherein the ratio of the height (h) of the ribs to the local height (H) of the duct is constant over the longitudinal extent of the ribs.

3. The cooling system as claimed in claim 1, wherein the height (h) of the ribs is variable over the blade height.

4. The cooling system as claimed in claim 1, wherein the pitch of the ribs of one of the side walls relative to the pitch of the other side wall is variable over the blade height.

* * * * *